United States Patent [19]

Hill et al.

[11] Patent Number: 4,609,308

[45] **Date of Patent: * Sep. 2, 1986**

[54] ROOF SUPPORT SUITABLE FOR USE IN MINES

[75] Inventors: Nigel Hill, Pershore; Neville J. H. Sleigh, Malvern, both of England

[73] Assignee: Dowty Mining Equipment Limited, Tewkesbury, England

[ * ] Notice: The portion of the term of this patent subsequent to Apr. 23, 2002 has been disclaimed.

[21] Appl. No.: 626,682

[22] Filed: Jul. 2, 1984

[30] Foreign Application Priority Data

Jul. 12, 1983 [GB] United Kingdom ..... 8318806

[51] Int. Cl.[4] ..... E21D 15/44; E21D 17/054

[52] U.S. Cl. ..... 405/293; 405/291

[58] Field of Search ..... 405/290–295; 299/33

[56] References Cited

U.S. PATENT DOCUMENTS

| | | | |
|---|---|---|---|
| 3,534,559 | 10/1970 | Seddon et al. | 405/294 |
| 4,447,174 | 5/1984 | Becker et al. | 405/293 |
| 4,512,686 | 4/1985 | Waters | 405/293 |

FOREIGN PATENT DOCUMENTS

| | | | |
|---|---|---|---|
| 1037734 | 8/1966 | United Kingdom | 405/294 |
| 1139870 | 1/1969 | United Kingdom . | |
| 1562845 | 3/1980 | United Kingdom . | |
| 2082236 | 3/1982 | United Kingdom | 405/295 |
| 840392 | 6/1981 | U.S.S.R. | 405/293 |

*Primary Examiner*—Cornelius J. Husar
*Assistant Examiner*—Nancy J. Stodola
*Attorney, Agent, or Firm*—Hayes, Davis & Soloway

[57] ABSTRACT

A roof support, suitable for use in mines, includes a roof-engageable canopy which comprises a main portion and an extension portion having a pivotal connection to the main portion. Actuator means is carried by the main portion. A wedge member, which is operable by the actuator means, is disposed between, and is engageable with, the main portion and a part of the extension portion projecting substantially beyond the said pivotal connection towards the actuator means. The wedge member is adapted arcuately to be movable by the actuator means and such arcuate movement effects tilting of the extension portion with respect to said main portion.

11 Claims, 5 Drawing Figures

ROOF SUPPORT SUITABLE FOR USE IN MINES

Figure 1:
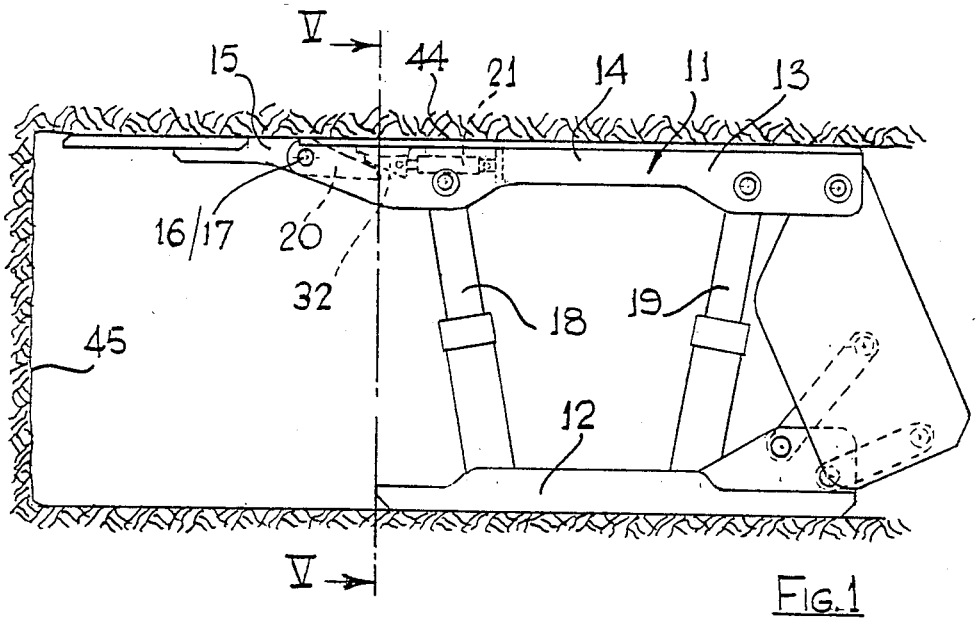

This invention relates to roof supports suitable for use in mines for supporting the mine roof during mineral-mining operations.

In the specification of U.S. Pat. No. 4,512,686 is described a roof support which includes a roof-engageable canopy comprising a main portion and an extension portion pivotally-connected to the main portion, actuator means carried by said main portion, and a wedge member so carried by said main portion and so connected with the output member of said actuator means as to be slidable, upon operation of said actuator means, lengthwise of said main portion. The end portion of said wedge member remote from said actuator means has a wedging face which is co-operable with a complementary face formed on a part of said extension portion which projects substantially beyond the pivotal connection in the direction towards said actuator means, whereby sliding movement of said wedge member effects tilting of the extension portion with respect to said main portion.

With such a support full area contact of one of the co-operable wedging faces with the other is not maintained for the complete range of tilting of the extension portion by its actuator means because no correction is there made for the motion of that portion. Thus, the extension portion cannot become fully load-bearing at all the positions of the wedge member in that range. In certain applications of the roof support this may be a serious disadvantage.

The invention as claimed is intended to provide a remedy. It solves the problem of how to design a roof support in which it is intended that full area contact of one of the co-operable wedging faces with the other is maintained for the complete range of tilting of the extension portion by its actuator means.

According to this invention a roof support, suitable for use in mines, includes a floor-engaging structure, extendable and contractible prop means carried by said structure, a roof-engageable canopy, supported by said prop means and comprising a main portion and an extension portion having a pivotal connection to said main portion, actuator means carried by said main portion, and a wedge member which is operable by said actuator means, which is disposed between, and engageable with, said main portion and a part of said extension portion projecting substantially beyond said pivotal connection towards said actuator means, and, which is adapted arcuately to be movable by said actuator means, such arcuate movement effecting tilting of said extension portion with respect to said main portion.

The wedge member may be formed with a flat wedging face co-operable with a complementary flat wedging face provided on said part of said extension portion. The wedge member may also be provided with an arcuate face which is co-operable with a complementary arcuate face provided on said main portion thus to afford said arcuate movement of said wedge member upon operation of said actuator means.

Preferably said wedge member is so disposed as to be movable generally lengthwise of said main portion of said canopy.

Preferably also said actuator means comprises a fluid-pressure-operable telescopic jack, the piston rod of which is pivotally-connected to, or engages, said wedge member.

The said main portion of the canopy may be of hollow form or alternatively of inverted channel-shaped cross-section and in this case the actuator means and wedge member are suitably housed within the interior thereof.

The advantages offered by the invention are mainly that since full area contact of one of the co-operable wedging faces with the other can be maintained for the complete range of tilting of the extension portion by said actuator means, the extension portion can be fully load-bearing at all the positions of the wedge member within that range. Also, tilting of the extension portion can be effected in a compact manner, and the actuator means can be horizontally-disposed, without the need for any pivotal driving linkage otherwise projecting into the space immediately beneath the canopy.

Figure 2:
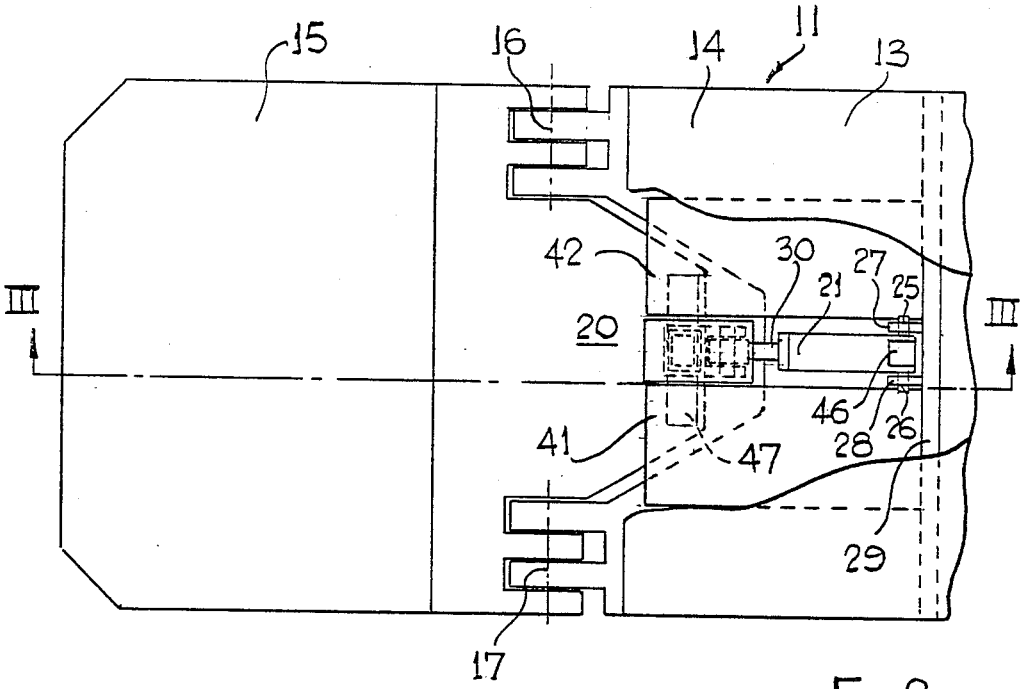
Figure 3:
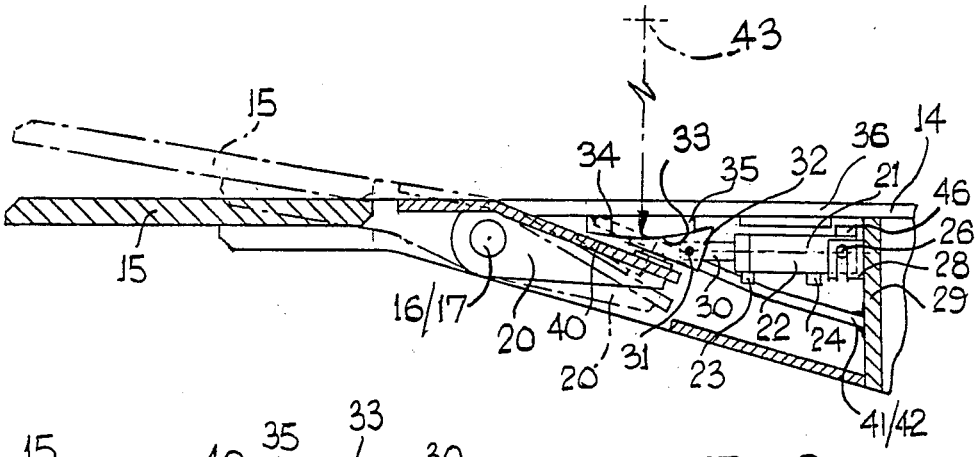
Figure 4:
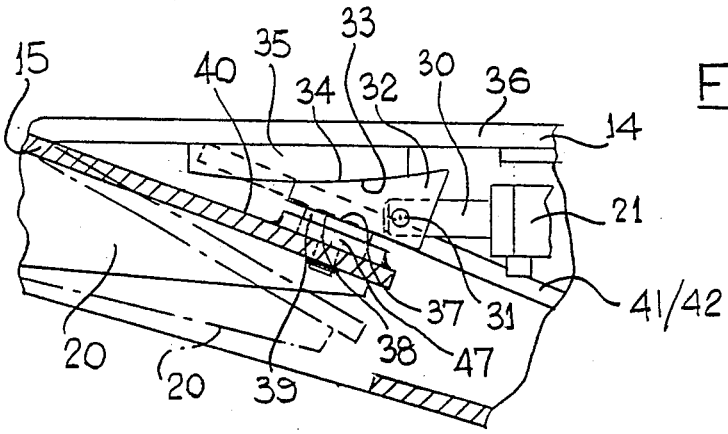
Figure 5:
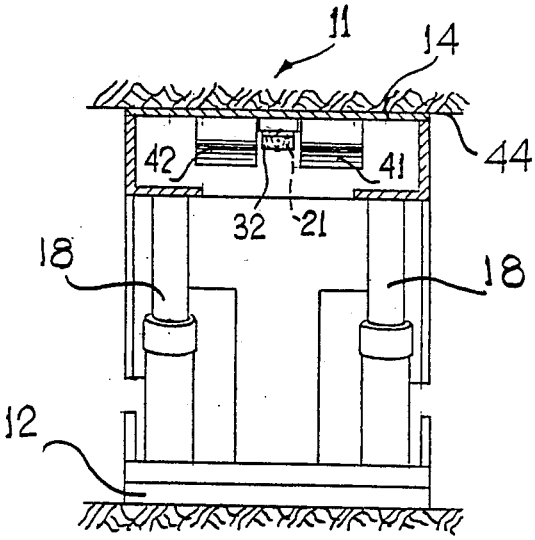

One way of carrying out the invention is described in detail below with reference to drawings which illustrate only one specific embodiment, in which:

FIG. 1 is a side elevation of a roof support in accordance with the invention, FIG. 2 is an enlarged, partly cut-away, plan view of part of the roof support shown in FIG. 1, FIG. 3 is an enlarged cross-section taken along the line III—III in FIG. 2, FIG. 4 is an enlarged scrap view of part of FIG. 3, and FIG. 5 is a cross-section taken along the line V—V in FIG. 1.

In the drawings a roof support 11, for use in a mine for supporting the mine roof during mineral-mining operations, comprises a mine floor-engaging structure in the form of a floor beam 12, a roof-engageable canopy 13 comprising a main portion 14 of inverted channel-shaped cross-section and an extension portion 15 suitably pivotally-connected thereto as shown at 16, 17. Prop means are provided comprising a pair of hydraulically extendable and contractible props 18 which are carried by beam 12 and which support portion 14 at its forward part and a pair of similar props 19 which are also carried by beam 12 and which support portion 14 at its rearward part.

A part 20 of extension portion 15 projects rearwardly, that is to the right in FIGS. 1 to 4, substantially beyond pivotal connections 16, 17 in the direction towards actuator means, in the form of a fluid-pressure-operable telescopic jack 21, which is mounted within the cross-sectional profile of main portion 14. The cylinder 22 of jack 21 is carried by transverse members 23, 24 and has trunnions 25, 26 which engage slotted plates 27, 28 mounted on a transverse vertical wall 29 of main portion 14. The free end portion of the piston rod 30 of the jack is pivotally-connected at 31 to a wedge member 32 also within the cross-sectional profile of main portion 14.

The wedge member is provided with an arcuate and concave upper face 33 which is co-operable with an arcuate and convex complementary face 34 provided on a block 35 fast with the underside of wall 36 of main portion 14. The wedge member is provided with a flat wedging face 37 on its underside which is co-operable with a complementary flat wedging face 38 formed on a pad 39. This pad is carried on the downwardly-sloping upper face 40 of the part 20 adjacent its free end. Transversely-spaced bracing members 41, 42 forming part of main portion 14 closely flank wedge member 32 which is caused to slide arcuately with respect to block 35 when operated by jack 21. Such arcuate sliding occurs about the axis 43 of generation of the face 34 of block 35 and applies a correction at the wedging faces for the pivotal motion of extension portion 15.

If, in operation of the roof support, canopy 13 is raised against the roof surface 44 where cavities and/or divergence in the mine roof exist adjacent the working surface 45 of the mine, it is necessary for extension portion 15 to be tilted upwardly into load-supporting engagement with the cavities and/or divergent roof surface. Accordingly jack 21 is extended causing wedge member 32 to slide arcuately with respect to block 35 and forwardly generally in the direction towards face 45. Thus the wedging face 37 of the wedge member slides upon face 38 of pad 39 causing portion 15 to tilt upwardly about pivotal connections 16, 17, for example to the position shown in broken lines in FIGS. 3 and 4.

Hydraulic liquid under pressure applied to jack 21 for such tilting operation is maintained in the jack to hold portion 15 in load-supporting engagement with the roof. However if the roof loading on portion 15 becomes excessive, that portion can yield, tilting downwardly about its pivotal connections 16, 17. Such movement, which is applied to jack 21 through the intermediary of wedge member 32, is permitted by the opening of yield valve means 46 associated with the jack.

If the roof forces are very high portion 15 can, in yielding, tilt as far downwardly as its position in which it is generally in-line with respect to main portion 41, piston rod 30 then being fully retracted and plate 47 engaging the underside of members 41, 42. Under these conditions yielding movement of portion 15 is resisted and loading upon that portion is then taken fully by the structure of main portion 14.

Thus in the embodiment above described extension portion 15 is capable of being set against the roof by wedging, followed by wedge yielding until the extension portion becomes fully load-bearing in the horizontal, or substantially horizontal, position.

Since, by the invention, sliding contact of the flat face 38 of pad 39 is maintained over its full area with the flat wedging face 37 of the wedge member for the complete range of available tilting movement of the extension portion by the jack, high contact stresses at those faces are avoided and the extension portion can be fully load-bearing at all positions of the wedge member in that range.

The invention is not limited to the form of wedge member as above described with reference to the accompanying drawings as in other embodiments of the invention and with advantage the wedge member may be of other suitable form, and/or otherwise suitably mounted, provided it is capable of such arcuate movement when operated by said actuator means as will ensure the maintaining of full area contact of one of the co-operable wedging faces with the other throughout the complete range of tilting of the extension portion by the actuator means.

Although in the embodiment above described with reference to the drawings the actuator means for effecting wedging and thus tilting of the extension portion of the canopy comprises a fluid-pressure-operable jack, in alternative embodiments of the invention the actuator means may be of other type suitable for housing within, or substantially within, the cross-sectional profile of the main portion of the canopy.

Further, although in the embodiment above described with reference to the drawings the jack is disposed with its longitudinal axis lying generally lengthwise of the main portion of the canopy and the wedge member is adapted to slide arcuately in that direction also, in alternative embodiments of the invention the actuator means is disposed with its longitudinal axis lying generally transversely of the main portion of the canopy and in this case the wedge member may also be adapted to slide arcuately in that direction.

We claim:

1. A roof support, suitable for use in mines, including a floor-engaging structure, extendable and contractible prop means carried by said structure, a roof-engageable canopy, supported by said prop means and comprising a main portion and an extension portion having a pivotal connection to said main portion, actuator means carried by said main portion, and a wedge member which is operable by said actuator means, which is disposed between and engageable with said main portion and a part of said extension portion projecting substantially beyond said pivotal connection towards said actuator means, and which is adapted arcuately to be movable by said actuator means, such arcuate movement effecting tilting of said extension portion with respect to said main portion.

2. A support as claimed in claim 1, wherein said wedge member is formed with a flat wedging face which is co-operable with a complementary flat wedging face provided on said part of said extension portion.

3. A support as claimed in claim 2, wherein said wedge member is also provided with an arcuate face which is co-operable with a complementary arcuate face provided on said main portion thus to afford said arcuate movement of said wedge member upon operation of said actuator means.

4. A support as claimed in claim 1, wherein said wedge member is so disposed as to be movable generally lengthwise of said main portion of said canopy.

5. A support as claimed in claim 1, wherein said actuator means comprises a fluid-pressure-operable telescopic jack, the piston rod of which is pivotally-connected to, or engages, said wedge member.

6. A support as claimed in claim 1, wherein said main portion of said canopy is of inverted channel-shaped cross-section.

7. A support as claimed in claim 6, wherein said actuator means and said wedge member are suitably mounted within the cross-sectional profile of said main portion.

8. A support as claimed in claim 3, wherein said complementary arcuate face is provided on a block forming part of said main portion and disposed on the underside thereof.

9. A support as claimed in claim 5, wherein transversely-spaced bracing members, forming part of said main portion, closely flank said wedge member.

10. A support as claimed in claim 9, wherein said part of said extension portion carries a plate so disposed that when said extension portion is in a position in which it is generally in-line with respect to said main portion, said piston rod of said jack then being fully retracted, said plate engages the underside of said bracing members.

11. A support as claimed in claim 2, wherein said complementary flat wedging face is formed on a pad carried on the upper face of said part of said extension portion and adjacent the free end of that part.

* * * * *